US010288051B2

(12) United States Patent
Andersen et al.

(10) Patent No.: US 10,288,051 B2
(45) Date of Patent: May 14, 2019

(54) HYDRAULIC MACHINE ARRANGEMENT

(71) Applicant: Danfoss A/S, Nordborg (DK)

(72) Inventors: Stig Kildegaard Andersen, Krusaa (DK); Poul Erik Hansen, Aabenraa (DK); Erik Haugaard, Graasten (DK)

(73) Assignee: Danfoss A/S, Nordborg (DK)

( * ) Notice: Subject to any disclaimer, the term of this patent is extended or adjusted under 35 U.S.C. 154(b) by 289 days.

(21) Appl. No.: 15/187,940

(22) Filed: Jun. 21, 2016

(65) Prior Publication Data

US 2016/0377070 A1 Dec. 29, 2016

(30) Foreign Application Priority Data

Jun. 26, 2015 (EP) ..... 15174079

(51) Int. Cl.

| | |
|---|---|
| ***F01B 31/00*** | (2006.01) |
| ***F04B 19/22*** | (2006.01) |
| ***F04B 1/12*** | (2006.01) |
| ***F04B 49/10*** | (2006.01) |
| ***F03C 1/06*** | (2006.01) |
| ***F04F 13/00*** | (2009.01) |

(52) U.S. Cl.

CPC ..... *F04B 19/22* (2013.01); *F03C 1/06* (2013.01); *F04B 1/12* (2013.01); *F04B 49/10* (2013.01); *F04F 13/00* (2013.01); *F04B 2201/0803* (2013.01)

(58) Field of Classification Search

CPC ..... F04F 13/00; F04F 27/109

See application file for complete search history.

(56) References Cited

U.S. PATENT DOCUMENTS

| | | | | |
|---|---|---|---|---|
| 2,747,843 | A * | 5/1956 | Cox | F04F 13/00 165/7 |
| 3,256,831 | A | 6/1966 | Eickmann | |
| 3,507,584 | A * | 4/1970 | Robbins, Jr. | F04B 1/124 92/86 |
| 3,582,241 | A | 6/1971 | Niemiec et al. | |
| 3,926,095 | A | 12/1975 | Weigle | |
| 3,947,046 | A | 3/1976 | Maruyama et al. | |
| 5,180,173 | A | 1/1993 | Kimura et al. | |

(Continued)

FOREIGN PATENT DOCUMENTS

| | | |
|---|---|---|
| CN | 2729318 Y | 9/2005 |
| CN | 102072149 A | 5/2011 |

(Continued)

OTHER PUBLICATIONS

European Search Report for European Application No. EP 15174079 dated Jan. 12, 2016.

European Search Report for European Application No. EP15174081 dated Jan. 12, 2016.

*Primary Examiner* — Michael Leslie

(74) *Attorney, Agent, or Firm* — McCormick, Paulding & Huber LLP

(57) ABSTRACT

A hydraulic machine arrangement (1) is described having a housing (5), a working section and a hollow inside said housing (5), a supply port arrangement LPin, HPin, LPout connected to said working area, and a leakage path (7) between said working section and said hollow. It should be possible to detect wear with simple means. To this end, said housing (5) is provided with a leakage port (8) connected to said hollow.

8 Claims, 4 Drawing Sheets

(56) References Cited

U.S. PATENT DOCUMENTS

| | | | | |
|---|---|---|---|---|
| 5,536,153 | A | 7/1996 | Edwards | |
| 5,571,268 | A | 11/1996 | Azibert | |
| 5,833,438 | A | 11/1998 | Sundberg | |
| 5,944,498 | A | 8/1999 | Wupper et al. | |
| 6,142,478 | A | 11/2000 | Pecht et al. | |
| 6,280,150 | B1 | 8/2001 | Miyazawa | |
| 8,387,558 | B2 | 3/2013 | Herre et al. | |
| 9,328,743 | B2 * | 5/2016 | Hirosawa | F04F 13/00 |
| 9,546,671 | B2 * | 1/2017 | Hirosawa | F04F 13/00 |
| 9,617,994 | B2 | 4/2017 | Walters et al. | |
| 9,945,216 | B2 * | 4/2018 | Ghasripoor | F04F 13/00 |
| 2003/0015840 | A1 | 1/2003 | Davis | |
| 2012/0043725 | A1 | 2/2012 | Jahn et al. | |
| 2013/0108498 | A1 | 5/2013 | Petersen et al. | |
| 2013/0108499 | A1 | 5/2013 | Petersen et al. | |
| 2014/0234150 | A1 | 8/2014 | Sugihara et al. | |
| 2015/0300352 | A1 | 10/2015 | Walters et al. | |

FOREIGN PATENT DOCUMENTS

| | | | |
|---|---|---|---|
| CN | 103075339 | A | 5/2013 |
| CN | 103562568 | A | 2/2014 |
| CN | 203532360 | U | 4/2014 |
| CN | 203641136 | U | 6/2014 |
| DE | 10 2005 056 909 | A1 | 5/2007 |
| EP | 2 495 441 | A1 | 9/2012 |
| EP | 2 662 565 | A1 | 11/2013 |
| GB | 1 378 627 | A | 12/1974 |
| GB | 2 032 010 | A | 4/1980 |
| JP | S62-178781 | A | 8/1987 |
| JP | 2006097497 | A | 4/2006 |
| JP | 2010-190383 | A | 9/2010 |
| WO | 2012/045995 | A2 | 4/2012 |
| WO | 2014/003626 | A1 | 1/2014 |

* cited by examiner

HYDRAULIC MACHINE ARRANGEMENT

CROSS REFERENCE TO RELATED APPLICATION

Applicant hereby claims foreign priority benefits under U.S.C. § 119 from European Patent Application No. 15174079 filed on Jun. 26, 2015, the content of which is incorporated by reference herein.

TECHNICAL FIELD

The present invention relates to a hydraulic machine arrangement having a housing, a working section and a hollow inside said housing, a supply port arrangement connected to said working area, and a leakage path between said working section and said hollow.

BACKGROUND

In the working section of the hydraulic machine arrangement there are, as a rule, parts moving relative to each other. These parts limit at least a pressure chamber the volume of which varies during one working cycle. The pressure in said working section is at least during a part of the working cycle higher than the pressure in the hollow. It is almost impossible to have the contact area between the moving parts absolutely tight so that a certain leakage occurs. Such leakage should be kept at a minimum. However, a certain leakage is acceptable, since this leakage forms a kind of lubrication flow.

The leakage is collected in the hollow and has to be transported away. To this end, the hollow is connected to a low pressure port of the supply pressure arrangement. When the hydraulic machine arrangement is in form of a pump, the hollow is often connected to a suction port of the supply port arrangement. In this way, it is avoided that a pressure builds up within the hollow.

The moving parts in the working section show some wear.

SUMMARY

The object underlying the invention is to have the possibility to detect wear with simple means.

This object is solved with a hydraulic machine arrangement as described at the outset in that said housing is provided with a leakage port connected to said hollow.

In such a machine arrangement, it is possible to have a look at the leakage flow. The leakage arriving at the hollow can escape through the leakage port. It is therefore possible to obtain information about the amount of the leakage and of the quality of the leakage, if necessary.

Preferably, said hollow is sealed against said supply port arrangement. In this case, the complete leakage flow has to flow through the leakage port. When the flow through the leakage port is investigated, it can be seen whether the leakage has been increased or not.

Preferably, said leakage port comprises a connecting geometry accessible from the outside of said housing. This connecting geometry allows for mounting parts and elements at the leakage port, if desired.

In a preferred embodiment a flow meter is connected to said leakage port. The flow meter is able to detect the flow of leakage through the leakage port. Monitoring of said leakage flow gives information about wear. In most cases leakage increases when wear increases.

In a preferred embodiment, an outlet of said flow meter is connected to a suction port of said supply port arrangement. This is a simple way to remove the leakage after detecting the leakage flow.

In another preferred embodiment a closure member is provided closing said leakage port. Not all users of a hydraulic machine arrangement will use the possibility to fix permanently a flow meter to said leakage port. When the flow meter is removed, the closure member can be used to close the leakage port.

Preferably, said machine arrangement comprises a pressure exchanger and a booster pump. Such a machine arrangement can be used, for example, in a reverse osmosis system of a water purification plant. In such a plant, there are usually a number of such hydraulic machine arrangements arranged in parallel. When the output of such a plant decreases, it is rather simple to identify the machine arrangement causing the problem. As a rule, this is the hydraulic machine arrangement having an abnormal leakage.

Preferably, a leakage flow path is provided from said booster pump to said pressure exchanger and said leakage port is provided at said pressure exchanger. This means that the leakage of the booster pump and the leakage of the pressure exchanger can be monitored through the same leakage port.

Preferably said machine arrangement comprises an axial piston pump. Such an axial piston pump can be used as well as booster pump.

BRIEF DESCRIPTION OF THE DRAWINGS

The preferred embodiment of the invention is now described in more detail with reference to the drawing, wherein.

DETAILED DESCRIPTION

Figure 1:
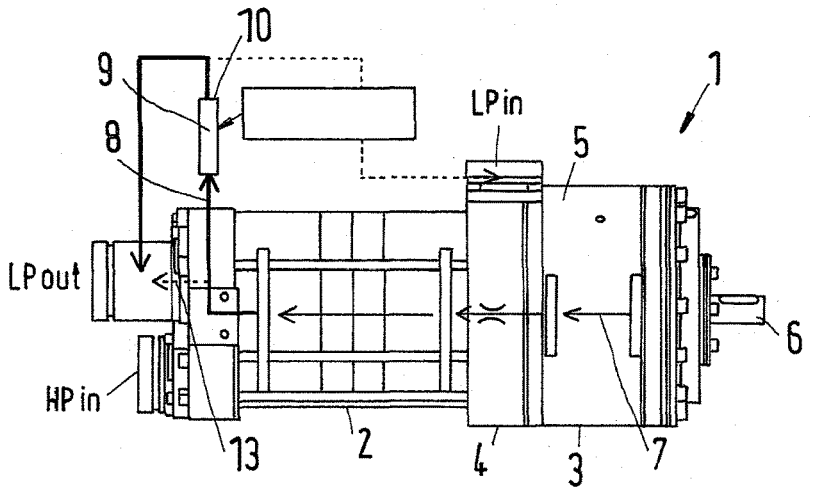
FIG. 1 shows a schematic illustration of a hydraulic machine arrangement.

FIG. 1 schematically shows a hydraulic machine arrangement 1 comprising a pressure exchanger 2 and a booster pump 3. The pressure exchanger 2 and the booster pump 3 are connected by means of a connecting flange 4. The pressure exchanger 2, the booster pump 3 and the connection flange 4 have, for the illustration of the present invention, a common housing 5.

The pressure exchanger 2 has a number of rotating cylinders 2*a*, 2*b* (FIG. 3), which are driven by means of an axis 6. The pressure exchanger 2 has a high pressure inlet port HPin and a low pressure outlet port LPout. The booster pump has a low pressure inlet port LPin and furthermore the booster pump 3 has a high pressure outlet port which is not shown in the drawing. The high pressure inlet port HPin, the low pressure outlet port LPout, the low pressure inlet port LPin and the high pressure outlet port (not shown) together form a supply port arrangement.

In the present case, the booster pump 3 is in form of a vane type pump in which the number of vanes limit a number of pressure chambers together with a rotor in which the vanes are arranged and a stator which is part of the housing 5. The rotor is arranged eccentrically within in a stator bore so that during rotation the vanes slide radially inwardly and outwardly so that the pressure chambers increase and decrease their volume.

The basic construction of the pressure exchanger 2 and of the booster pump 3 is known from the state of the art and will therefore not be described in more detail.

The above described rotating cylinders and the rotor with the vanes form a working section. When the parts of the working section are moved relative to each other a leakage occurs which is acceptable since the leakage forms a lubrication flow. This lubrication flow escapes from the working section into a hollow within the housing 5. A leakage flow path 7 is indicated by arrows. It can be seen that the leakage flow path 7 runs from the booster pump 3 to the pressure exchanger 2.

The pressure exchanger 2 comprises additionally a leakage port 8 which is connected to the leakage flow path 7, i.e. to the hollow of the housing 5. A flow meter 9 is connected to the leakage port 8. Furthermore, the hollow of the housing 5 is sealed against the supply port arrangement HPin, LPout, LPin so that the complete leakage flow has to run through the leakage port 8 and through the flow meter 9. In this way, it is possible to monitor the leakage flow and to detect whether the leakage flow is constant or whether it increases or decreases. As long as the leakage flow is constant, there is usually no problem. As soon as the leakage flow increases or decreases, this may be an indication of an abnormal wear which requires an inspection of the hydraulic machine arrangement 1.

The flow meter comprises an outlet 10 which is connected to the low pressure outlet port LPout of the pressure exchanger 2 so that it is possible to dispose of the leakage flow through the low pressure outlet port LPout.

Another possibility is shown with a dotted line. The outlet 10 of the flow meter 9 is connected to the low pressure inlet port LPin of the booster pump 3. In this way, the leakage flow is not only disposed of but it is reused in the booster pump 3.

In some cases it is not required or intended to use permanently the flow meter 9.

Figure 2:
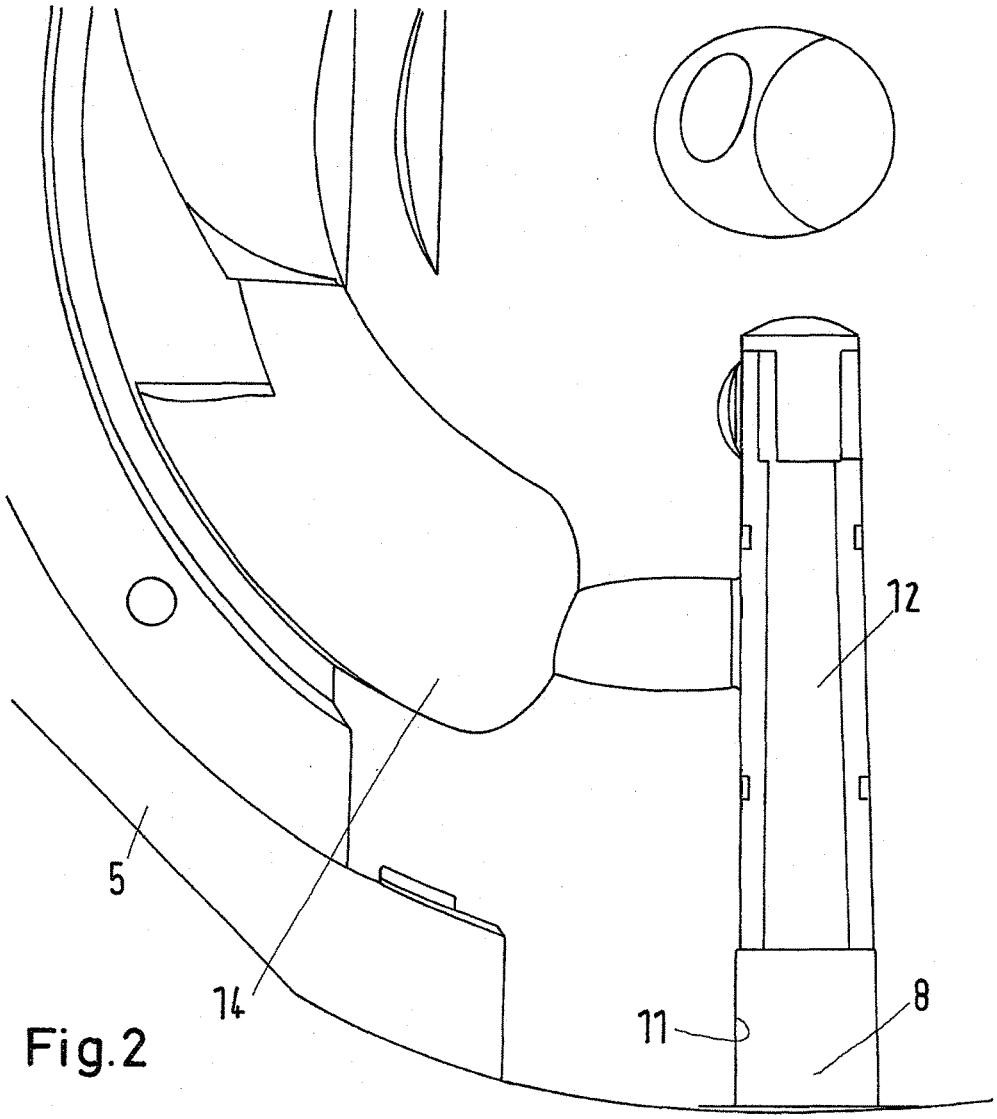
FIG. 2 shows an enlarged view of a leakage port.

As shown in FIG. 2, the leakage port 8 comprises a connection geometry 11, e.g. in form a thread. A complementary connection geometry of the flow meter 9 can be screwed into the connection geometry 11.

If the flow meter 9 is not used, the user can screw a closure member 12 into said leakage port 8 to close the leakage port 8. In this case an alternative leakage flow path 13 is established connecting the hollow 14 of the housing 5 with the low pressure outlet port LPout. This connection can be made, if required, by the closure member 12.

Figure 3:
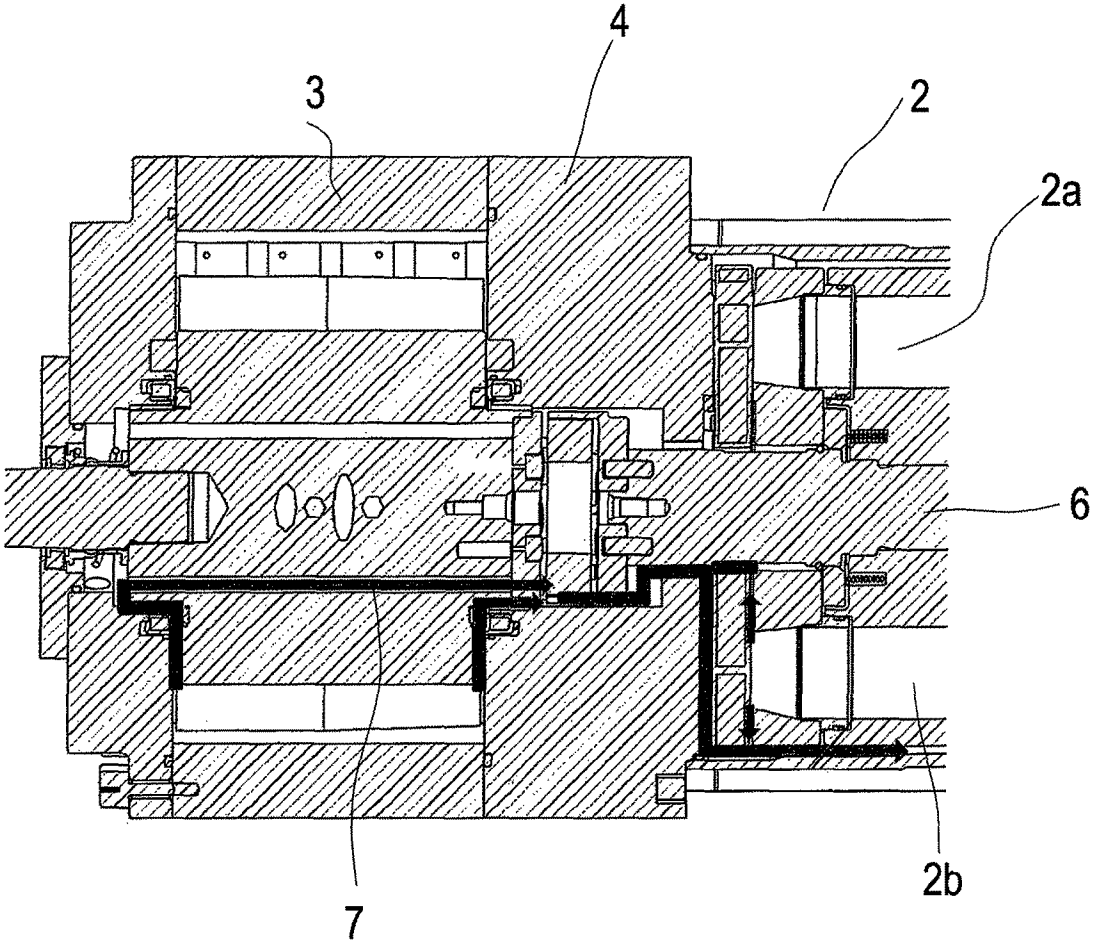
FIG. 3 shows a schematic illustration of a leakage flow path in the hydraulic machine arrangement.
Figure 4:
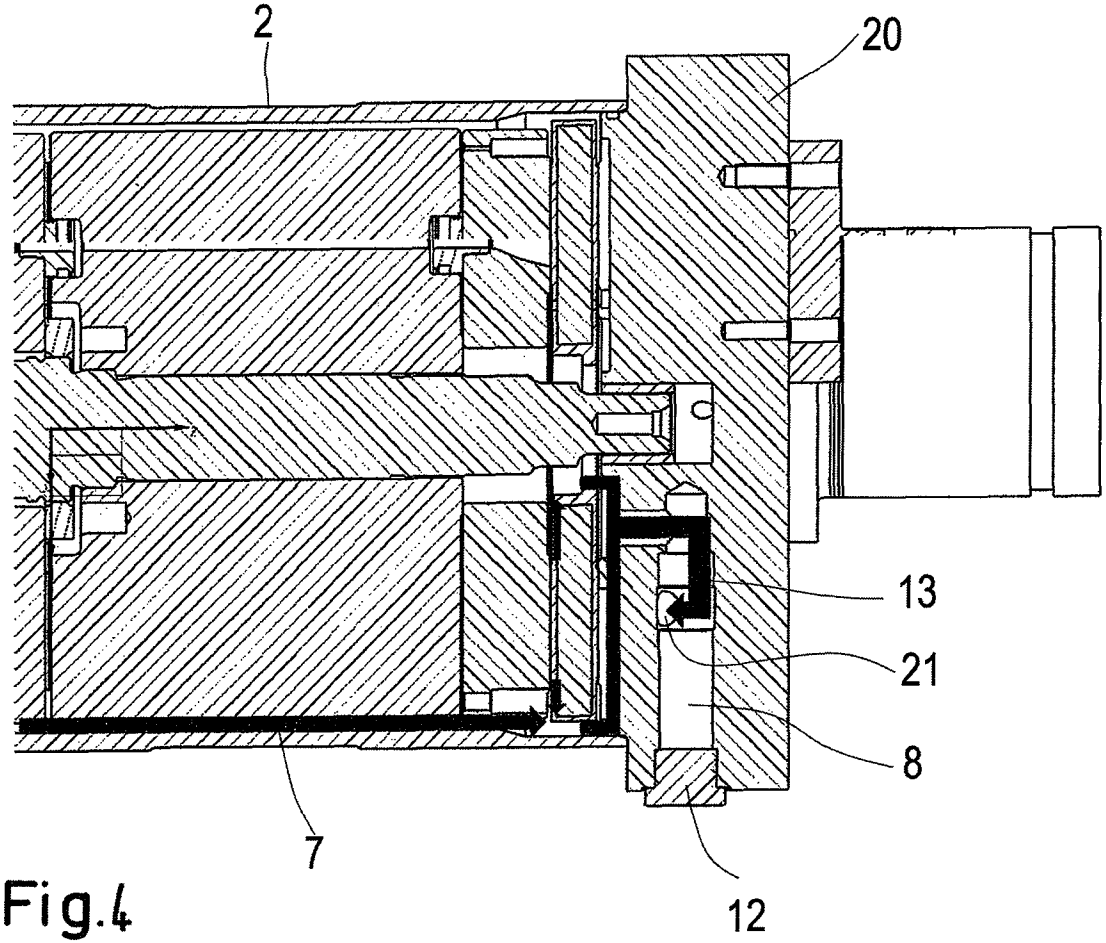
FIG. 4 shows schematically a leakage flow diverted to a low pressure outlet port, and FIG. 5 schematically shows a leakage flow path diverted out of the machine arrangement.
Figure 5:
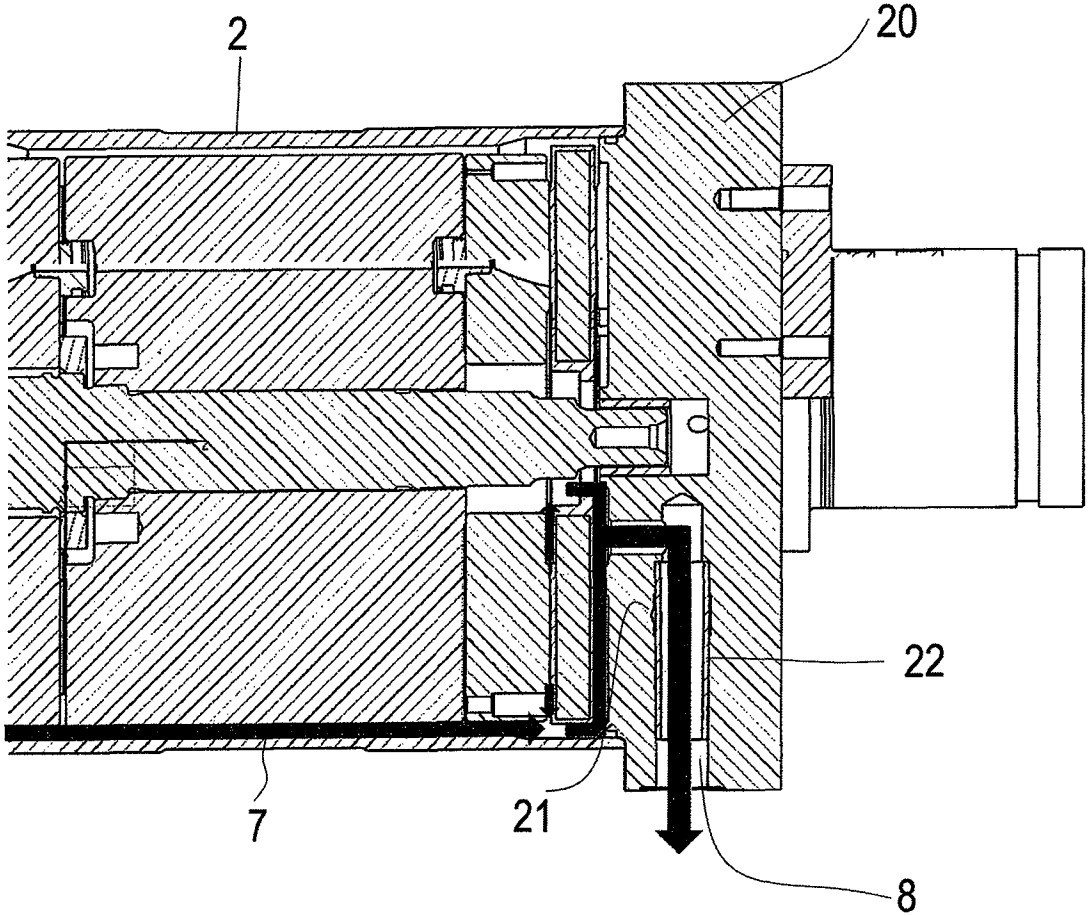

FIGS. 3 to 5 schematically show more clearly the leakage flow path 7. Reference numerals used in FIGS. 1 and 2 are used in FIGS. 3 to 5 for the same elements.

The leakage flow path 7 starts at both ends of the vanes of the booster pump 3. The part of the leakage flow path 7 starting from the axial inner end of the booster pump 3, i.e. the end neighboring the connecting flange 4, enters directly the connecting flange 4. The part of the leakage flow path 7 starting from the axial outer end of the booster pump 3 crosses the booster pump 3 lengthwise and joins with the other part of the leakage flow path in the connecting flange 4.

After passing the connecting flange 4, the leakage flow path 7 runs through the pressure exchanger 3 outside the cylinders 2*a*, 2*b* and enters an end plate 20. The end plate 20 comprises the leakage port 8.

As shown in FIG. 4, the leakage port 8 is closed by the closure member 12, which is in form of a plug or the like. In this case the leakage flow path 7 is diverted to the low pressure output port LPout via a channel 21.

FIG. 5 shows an alternative. In this case the leakage port 8 is opened to the outside. A pipe 22 is inserted into the leakage port 8 and closes the channel 21 leading to the low pressure outlet port LPout so that the leakage flow path 7 is diverted out of the machine arrangement 1.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A hydraulic machine arrangement comprising:
- a housing,
- a working section and a hollow inside said housing,
- a supply port arrangement (LPin, HPin, LPout) connected to said working section,
- a leakage path between said working section and said hollow,
- a pressure exchanger, and
- a booster pump,
- wherein said housing is provided with a leakage port connected to said hollow, and
- wherein said leakage path is provided from said booster pump to said pressure exchanger and said leakage port is provided at said pressure exchanger.

2. The hydraulic machine arrangement according to claim 1, wherein said hollow is sealed against said supply port arrangement (LPin, HPin, LPout).

3. The hydraulic machine arrangement according to claim 2, wherein said leakage port comprises a connecting geometry accessible from the outside of said housing.

4. The hydraulic machine arrangement according to claim 1, wherein said leakage port comprises a connecting geometry accessible from the outside of said housing.

5. The hydraulic machine arrangement according to claim 4, wherein a closure member is provided closing said leakage port.

6. The hydraulic machine arrangement according to claim 4, wherein a flow meter is connected to said leakage port.

7. The hydraulic machine arrangement according to claim 6, wherein an outlet of said flow meter is connected to said supply port arrangement (LPin, HPin, LPout).

8. The hydraulic machine arrangement according to claim 7, wherein said outlet of said flow meter is connected to a suction port (LPin) of said supply port arrangement (LPin, HPin, LPout).

* * * * *